United States Patent [19]

Derby, III

[11] Patent Number: 4,869,702

[45] Date of Patent: Sep. 26, 1989

[54] HAND ACTUATED PUPPET AND PRECURSOR STRUCTURE

[75] Inventor: Leslie B. Derby, III, Mechanicsville, Va.

[73] Assignee: Prescott Durrell & Company, Richmond, Va.

[21] Appl. No.: 227,072

[22] Filed: Aug. 1, 1988

[51] Int. Cl.[4] ..... A63H 3/14; A63H 3/08; A63H 33/00

[52] U.S. Cl. ..... 446/329; 446/387; 446/488; 40/539

[58] Field of Search ..... 446/329, 387, 328, 327, 446/385, 388, 488, 487, 79, 80, 147, 150, 151, 152; 40/539

[56] References Cited

U.S. PATENT DOCUMENTS

| | | | |
|---|---|---|---|
| 2,709,319 | 5/1955 | Baltin | 446/488 X |
| 3,521,399 | 7/1970 | Deal | 446/329 |
| 3,917,153 | 11/1975 | Holschneider | 446/480 X |
| 4,000,579 | 1/1977 | Gornall | 446/329 X |
| 4,555,236 | 11/1985 | Peyton | 446/329 |

FOREIGN PATENT DOCUMENTS

| | | | |
|---|---|---|---|
| 2053010 | 2/1981 | United Kingdom | 446/488 |

OTHER PUBLICATIONS

Cooper–4/73–Puppet Faces.

*Primary Examiner*—Robert A. Hafer
*Assistant Examiner*—D. Neal Muir
*Attorney, Agent, or Firm*—Norman B. Rainer

[57] ABSTRACT

A hand actuated puppet, useful for entertainment, instructional and demonstration purposes has a grasping capability easily mastered by children. The puppet is fabricated from a single piece of sheet stock cut and folded so as to have an upper face panel, a lower panel, and a connecting hinge panel. The upper and lower panels are equipped with finger engaging loops which facilitate manipulation.

7 Claims, 2 Drawing Sheets

HAND ACTUATED PUPPET AND PRECURSOR STRUCTURE

BACKGROUND OF THE INVENTION

This invention concerns puppets useful for entertainment, instructional and demonstration purposes, and more particularly relates to puppets operable by a single hand and having a grasping capability easily mastered by children.

There are many different kinds of puppets designed to produce entertaining movements based upon the manipulative efforts of the operator. U.S. Pat. No. 4,555,236 describes a puppet which may be deployed from a flattened storage state to a functional state enabling single hand operation and adapted to grasp and lift flat objects. The advantage of the flattened storage state is that the puppet may be included wihtin a book or multi-media kit whose subject content is related to the appearance of the puppet.

However, the puppet of U.S. Pat. No. 4,555,236, even in its flattened state, is of an appreciable thickness caused by six layers of stiff paper or cardboard sheet stock. Also, a certain amount of cost is involved in the fabrication and assembly of three separate components that comprise the puppet.

It is accordingly an object of the present invention to provide a puppet adapted for single hand manipulation.

It is another object of this invention to provide a puppet as in the foregoing object having grasping capability and useful for instructional purposes.

It is still another object of the present invention to provide a puppet of the aforesaid nature which can be easily deploy from a flat precursor structure representing the storage state of the puppet.

It is a further object of the present invention to provide a puppet of the aforesaid nature of simple, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a puppet comprised of a single piece of substantially rigid sheet stock cut and folded so as to have:

(a) a flat upper panel representing the face of a person or animal, said panel having front and rear extremities, upper and lower surfaces, and opposed side edges, (b) a flat lower panel adapted to be disposed generally beneath said upper panel, and having front and rear extremities, upper and lower surfaces, and opposed side edges, (c) a flat connecting panel extending between the front extremity of the upper panel and rear extremity of the lower panel and thereby forming with said upper and lower panels an N-shaped hinge structure permitting the front extremity of the upper panel to be controllably and reversibly brought into contact with the upper surface of the lower panel at a site rearwardly displaced from the front extremity of said lower panel, (d) upper finger engaging means disposed upon the lower surface of the upper panel, and (e) lower finger engaging means disposed upon the lower surface of the lower panel.

In preferred embodiments, the sheet stock is cardboard having embossed, perforated or otherwise preweakened fold lines which define said connecting panel as a portion disposed between said upper and lower panels. Certain features of the puppet, such as nose or eyes may be apertures die-cut from the sheet stock. Other features of the puppet may be raised, pushed out, embossed, or laminated to give the appearance of a third dimension. The sheet stock may have appropriate printed indicia or colorations to enhance the visual effect of the puppet. The sheet stock is cut to a shape which is substantially symmetrical with respect to an axis running between said upper and lower panels and perpendicular to said fold lines, thereby causing the deployed puppet to have substantially a vertical plane of symmetry. The finger engaging means are preferably formed from tabs emergent from said opposed side edges, and which interlock to create a closed encircling loop into which the thumb or the fingers can be inserted.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
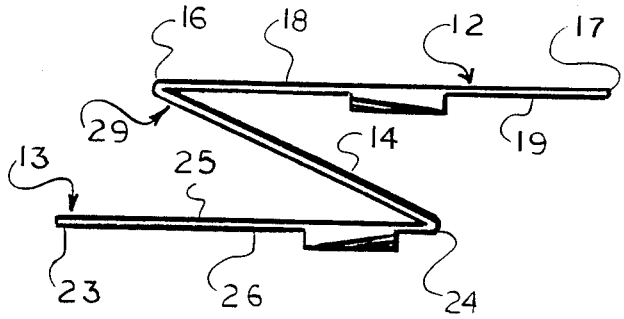
FIG. 1 is a side view of an embodiment of the puppet of this invention, shown in its deployed, functional state.

Referring to FIGS. 1–6, an embodiment of the puppet of this invention is shown comprised of a monolithic single sheet of cardboard 10 having embossed parallel fold lines 11 which define upper panel 12, lower panel 13 and connecting panel 14.

Upper panel 12 is bounded by front and rear extremities 16 and 17, respectively, upper and lower surfaces 18 and 19, respectively, and opposed side edges 20. The front and rear extremities and side edges in combination define a perimeter 21 having the contour of the face or head of a person or animal. Printed indicia 22 disposed upon upper surface 18 further enhance the appearance of a face or head.

lower panel 13 is bounded by front and rear extremities 23 and 24, respectively, upper and lower surfaces 25 and 26, respectively, and opposed side edges 27. The front and rear extremities and side edges in combination define a perimeter 28 whose contour is compatible with or enhances the appearance of the face or head presented by said upper panel.

Connecting panel 14 extends between the front extremity 16 of upper panel 12 and the rear extremity 24 of lower panel 13, being essentially defined by parallel fold lines 11 which further constitute said front extremity 16 and rear extremity 24. In the deployed, functional state of the puppet, the aforesaid relationship of upper, lower and connecting panels creates an N-shaped hinge structure 29 as shown most clearly in FIG. 1. The nature of the hinge structure is such as to permit front extremity 16 of upper panel 12 to be brought into grasping contact with upper surface 25 of lower panel 13 at a site 30 rearwardly displaced from front extremity 23 of lower panel.

Figure 2:
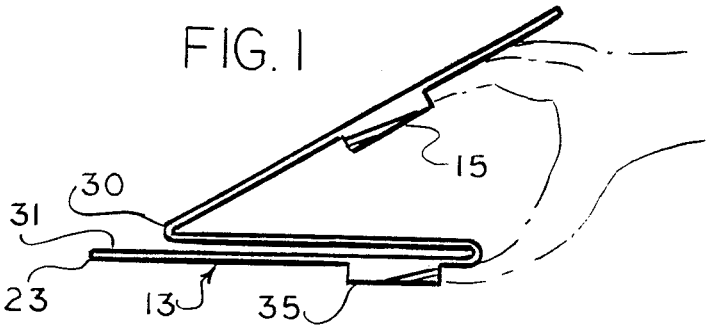
FIG. 2 shows the puppet of FIG. 1 in its grasping configuration.
Figure 3:
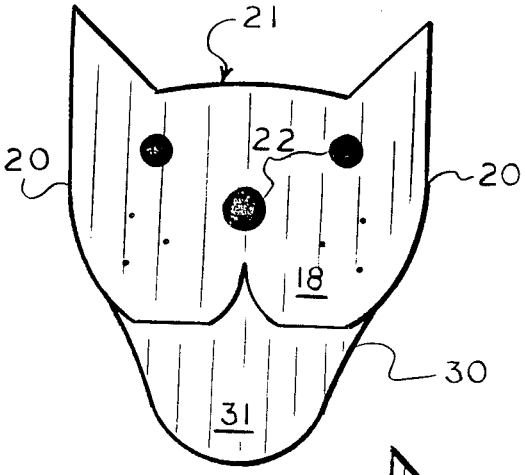
FIG. 3 is a top view of the puppet of FIG. 1.
Figure 4:
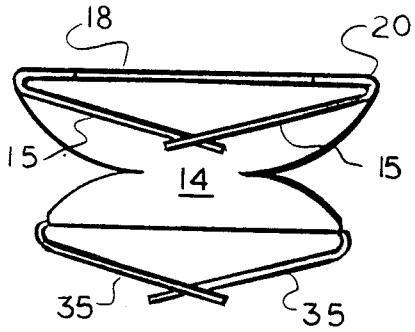
FIG. 4 is a rear view of the puppet of FIG. 1.
Figure 5:
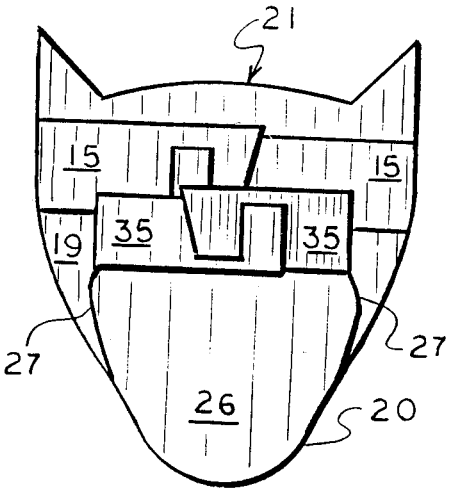
FIG. 5 is a bottom view of the puppet of FIG. 1.
Figure 6:
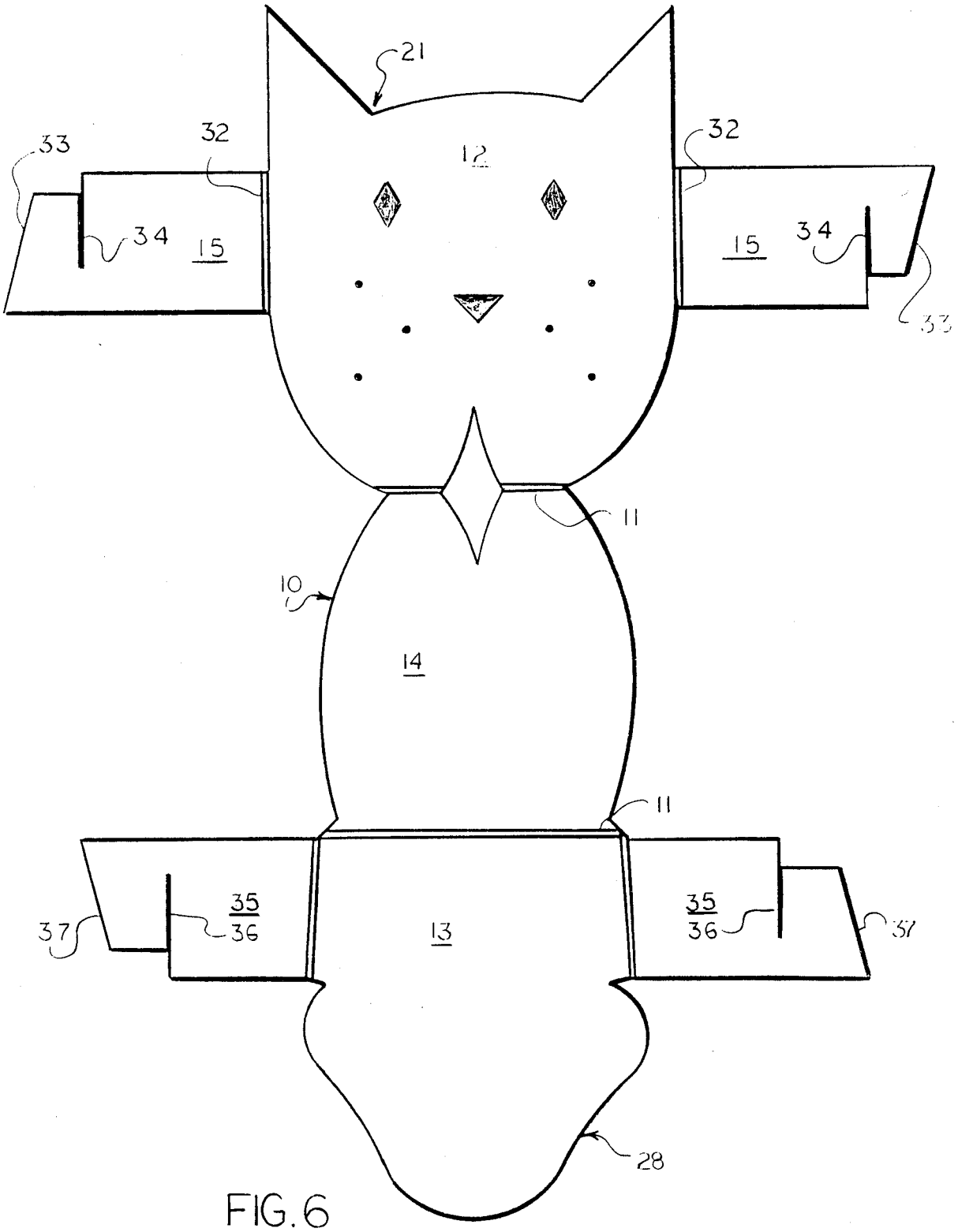
FIG. 6 is a plan view of a sheet of precursor cardboard from which the puppet of FIG. 1 is formed.

In said grasping configuration, as shown in FIG. 2, a portion 31 of lower panel 13 protrudes forwardly of site 30, thereby constituting a lip which can be inserted beneath objects to be grasped. It is also to be noted that, in the grasping configuration, upper panel 12 is downwardly angled toward the front extremity 23 of lower panel 13.

Upper finger engaging means in the form of interengaged tabs 15 are disposed upon lower surface 19 of upper panel 12. Said tabs are continuous integral appendages of side edges 20 of upper panel 12, and are delineated by fold lines 32. Distal extremities 33 of said tabs are provided with oppositely directed slits 34 which permit scissor-like interengagement of the tabs to define, along with said upper panel, a closed loop structure.

In similar fashion, lower finger engaging means in the form of tabs 35 are disposed upon lower surface 26 of lower panel 13, said tabs being interengaged by means of oppositely directed slits 36 adjacent their distal extremities 37.

By virtue of the specialized structure and operation of the puppet, as described hereinabove, the puppet can be stored in its flatted state in a book, and can be easily deployed to its functional state. The hinged construction, in conjunction with the upper and lower finger engaging means and protruding lip portion, enable the puppet to grasp objects. The objects to be grasped are preferably flat instructional cards resting upon a flat surface.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A puppet comprised of a single piece of substantially rigid sheet stock cut and folded so as to have:

(a) a flat upper panel representing the face of a person or animal, said panel having front and rear extremities, upper and lower surfaces, and opposed side edges, (b) a flat lower panel adapted to be disposed generally beneath said upper panel, and having front and rear extremities, upper and lower surfaces, and opposed side edges, (c) a flat connecting panel extending between the front extremity of the upper panel and rear extremity of the lower panel and thereby forming with said upper and lower panels an N-shaped hinge structure permitting the front extremity of the upper panel to be controllably and reversibly brought into contact with the upper surface of the lower panel at a site rearwardly displaced from the front extremity of said lower panel, causing said upper panel to be downwardly angled toward the front extremity of said lower panel, (d) upper finger engaging means disposed beneath the lower surface of the upper panel and formed from tabs emergent from said opposed side edges and which interlock to create a closed encircling loop into which fingers can be inserted, and (e) lower finger engaging means disposed beneath the lower surface of the lower panel and formed from tabs emergent from said opposed side edges and which interlock to create a closed encircling loop into which a thumb can be inserted, (f) the front and rear extremities of the upper panel being rearwardly displaced with respect to the corresponding front and rear extremities of the lower panel.

2. The puppet of claim 1 wherein the sheet stock is cardboard having pre-weakened fold lines which define said connecting panel as a portion disposed between said upper and lower panels.

3. The puppet of claim 1 having a perimeter substantially symmetrical with respect to an axis running between said upper and lower panels and perpendicular to said fold lines, thereby defining a plane of symmetry vertical to said puppet.

4. The puppet of claim 3 wherein the configuration of the perimeter enhances the appearance of the face represented by said upper panel.

5. The puppet of claim 1 having printed indicia disposed upon the upper surface of said upper panel to enhance the appearance of the face represented by said upper panel.

6. A flat piece of substantially rigid sheet stock having printed indicia and fold lines and constituting the precursor for the formation of the puppet of claim 1.

7. A kit comprising a book having enclosed therein the flat sheet stock of claim 6.

* * * * *